United States Patent [19]

Saitoh

[11] 4,266,769

[45] May 12, 1981

[54] TOY RACING CAR AND CIRCUIT

[75] Inventor: Shigeru Saitoh, Tokyo, Japan

[73] Assignee: Masudaya Toy Company Limited, Tokyo, Japan

[21] Appl. No.: 943,165

[22] Filed: Sep. 18, 1978

[30] Foreign Application Priority Data

Feb. 15, 1978 [JP] Japan ..... 53/17027[U]

[51] Int. Cl.[3] ..... A63H 18/16

[52] U.S. Cl. ..... 273/86 B; 46/1 K; 46/257

[58] Field of Search ..... 273/86 R, 86 B; 46/1 K, 46/202, 210, 251, 257

[56] References Cited

U.S. PATENT DOCUMENTS

| | | | |
|---|---|---|---|
| 2,687,304 | 8/1954 | Northrop et al. | 273/86 B |
| 3,858,875 | 1/1975 | Nemeth et al. | 46/1 K X |
| 4,055,021 | 10/1977 | Okamoto | 46/251 X |

FOREIGN PATENT DOCUMENTS

| | | | |
|---|---|---|---|
| 2110253 | 10/1972 | Fed. Rep. of Germany | 46/202 |
| 2148830 | 4/1973 | Fed. Rep. of Germany | 46/202 |
| 2204913 | 8/1973 | Fed. Rep. of Germany | 46/262 |
| 723834 | 2/1955 | United Kingdom | 46/210 |

*Primary Examiner*—Anton O. Oechsle

*Attorney, Agent, or Firm*—Michael J. Striker

[57] ABSTRACT

A toy racing assembly includes a toy racing car having a drive and a speed shifting device, and a toy racing track arranged for guiding the car during running and having at least at one location of the track a formation operative for actuating the speed shifting means of the car when the car passes the formation and engages the latter, whereby the speed of the car is shifted. The engaging formation may be formed as a projection on a gate member which is provided on the track. The track may include a section having an uneven road surface, an irregularly shaped plate cam member extending onto the road surface of the track, and guardrails located at both lateral sides of the track. Thereby, the car can jump on the uneven road surface, collide against the plate cam member, and collide against the lateral guardrails.

25 Claims, 9 Drawing Figures

TOY RACING CAR AND CIRCUIT

BACKGROUND OF THE INVENTION

The present invention relates to a toy racing assembly including a toy racing track, and a toy racing car which runs on the track.

Toy racing assemblies of the above known type have been proposed in the art. The toy racing cars of such assemblies are provided with electric motors and run on the toy racing tracks at a high speed. However, such assemblies do not have means for varying the speed and the running direction of the cars. For this reason these toy assemblies are substantially monotonous for playing children.

SUMMARY OF THE INVENTION

Accordingly, it is an object of the present invention to provide a toy racing assembly which avoids the disadvantages of the prior art.

More particularly, it is an object of the present invention to provide a toy racing assembly which is more amusing and attractive for playing children.

In keeping with these objects and with others which will become apparent hereinafter, one feature of the present invention resides, briefly stated, in a toy racing assembly which has a toy racing car provided with driving means and speed shifting means, and a toy racing track arranged for guiding the car during running and having at least at one location of the track a formation operative for actuating the speed shifting means of the car when the car passes the formation and engages the latter, whereby the speed of the car is shifted. The speed shifting means may be operative for shifting the speed of the car between at least two speeds one of which speeds is lower whereas the other speed is higher.

When the toy assembly is constructed in accordance with the present invention, the toy racing car can change its speed when it passes the formation of the toy racing track. Such a toy racing assembly is more amusing and attractive for playing children.

In accordance with another feature of the present invention the above-mentioned formation may be formed as a projection of a gate member arranged on the track. The projection may extend from one portion of the gate member and downwardly into an inner passage of the latter, whereas another portion of the gate member may be free from the projection. The other portion of the gate member may have such a height that the car freely passes this portion of the gate member. On the other hand, the projection of the first-mentioned portion of the gate member may extend to such a height that it engages the speed shifting means of the car. In such a construction when the car passes through the other portion of the gate member its speed is not shifted, whereas when the car passes through the one portion of the gate member it engages the projection of its speed is shifted.

Still another feature of the present invention is that the driving means of the car includes an electric motor having an electric circuit, whereas the speed shifting means includes a resistance and actuating means for electrically connecting the resistance to and electrically disconnecting the same from the electric circuit of the electric motor in dependence upon a position of the car relative to the engaging formation of the track. When the resistance is electrically connected with the electrical circuit of the electric motor the car driven by the electric motor runs at a lower speed. On the other hand, when the resistance is disconnected from the electric circuit of the electric motor the car runs at a higher speed.

The actuating means may include two plate members which form electric contacts of the resistance. At least one of the plate members is movable relative to the other plate member so as to establish and to interrupt contact between the plate members in dependence upon a position of the car relative to the engaging formation of the track. Means is provided for moving the plate members to respective positions thereof. The moving means includes a cam having two groups of faces which are spaced by differing distances from an axis of rotation of the cam, and a claw wheel mounted on a common axle with the cam for joint rotation with the latter. The claw wheel has a plurality of claws engagable with the engaging formation of the tack. When the car passes the above-mentioned first portion of the gate member, at least one claw of the claw wheel engages the projection of the gate member, the claw wheel turns and, in turn, turns the cam so that one of the above-mentioned faces of the cam moves the one plate member toward or apart from the other plate member. The plate members electrically disconnect the resistance from or connect the same with the electric circuit of the electric motor, whereby the electric motor is driven at a higher or lower voltage so that the running speed of the car is shifted.

In accordance with a further feature of the present invention the car may have an opening in a top wall of its body, and at least one claw of the claw wheel may extend through the opening and outwardly beyond the top wall of the car body. The cam element may have the faces whose number and location correspond to those of the claws of the claw wheel.

Still a further feature of the present invention is that the track may have a section provided with an uneven road surface (chicane). The above-mentioned surface may be formed by a plurality of strips extending in a direction transverse to the direction in which the track extends. When the car runs on the uneven road surface of this section it jumps so that the amusing and attractive effect of the assembly is further improved.

An additional feature of the present invention is that the track may be provided with a freely rotatable plate cam member which may be mounted on a spindle fixed in a lateral extension of the track. The plate cam member may have an irregular shape. During running on the track the car can collide with the irregularly shaped plate cam and thereby change its direction at random.

Still an additional feature of the present invention is that the track is provided with guardrails which extend in the direction of elongation of the track and are located at both lateral sides of the latter. During running on the track the car can collide with the guardrails and thereby change its running direction at random. The provision of the rotatable irregularly shaped cam member as well as of the guardrails further improves the amusing and attractive effect of the assembly.

The track of the assembly has such a width that two such cars can run on the track in parallel with one another.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
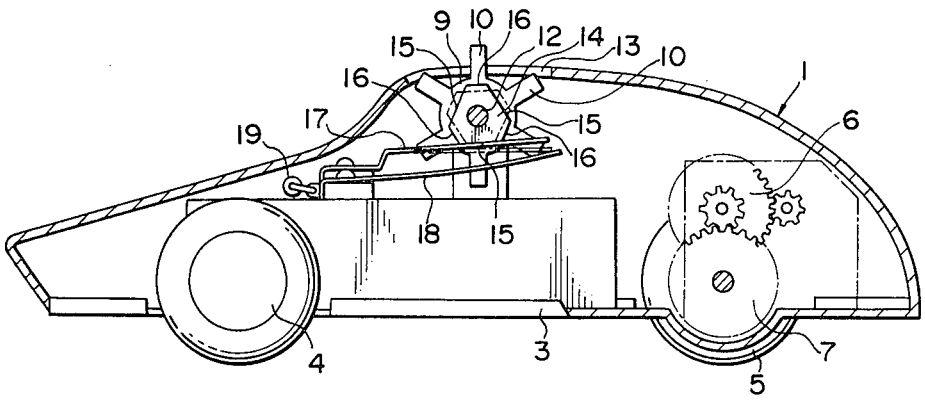
FIG. 1 is a view showing a longitudinal section of a toy racing car of a toy racing assembly, in accordance with the present invention.
Figure 2:
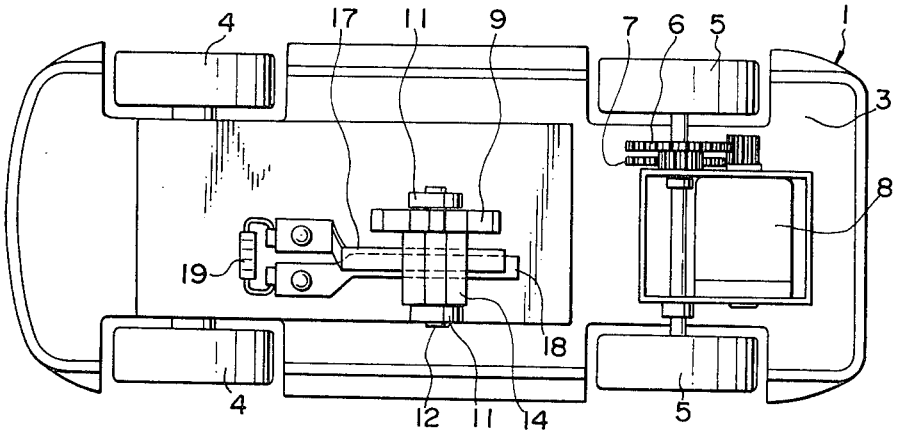
FIG. 2 is a plan view of the toy racing car shown in FIG. 1, wherein a body of the car is removed.

A toy racing assembly in accordance with the present invention has a toy racing car which is identified in toto by reference numeral 1 and a toy racing track which is identified in toto by reference numeral 22. The racing car 1 has a body 2, a base plate 3, and pairs of front wheels 4 and rear wheels 5. The wheels 4 and 5 are journalled on the base plate 3 and actuated by an electric motor 8 which is arranged to drive the rear wheels 5 through reduction gears 6 and 7.

A claw wheel 9 is provided, comprising a plurality of claws 10, for instance six claws, which have flat ends. The claw wheel 9 is idly mounted on a spindle 12 which is set on a pair of support plates 11. The latter are supported by the base plate 3. A top wall of the body 2 has an opening 13, and the claw wheel 9 is so arranged that each of the claws 10 can protrude through the opening 13 outwardly of the body 2. A hexagonal prismatic cam 14 is provided, having faces 15 and 16 which are arranged alternately in the circumferential direction of the cam. The cam 14 is mounted on the spindle 12 coaxially with the claw wheel 9. Preferably, the cam 14 is formed as an integral member with the claw wheel 9. The cam 14 is so arranged relative to the claw wheel 9 that the respective faces 15 and 16 of the cam 14 occupy the same angular locations as the claws 10 of the claw wheel 9.

Figure 3:
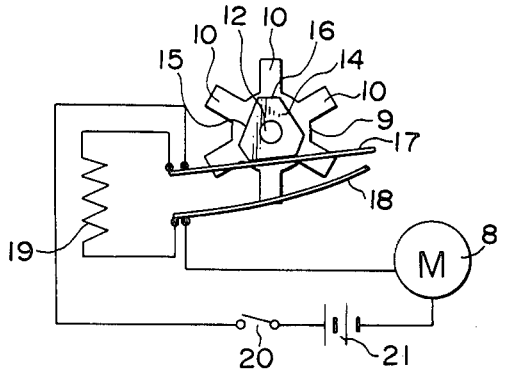
FIG. 3 is a view showing a connection diagram of means for driving toy racing car and means for shifting the speed thereof.

The electric motor 8, dry cells 21, a resistance 19 and a switch 20 are electrically connected with one another and together form an electric circuit as shown in FIG. 3. Upper and lower resilient or spring plates 17 and 18 are connected in parallel with the resistance 19, and an end of each plate is connected to a respective end of the latter. The plates 17 and 18 are located under the cam 14 and spaced from one another. The upper plate 17 is urged to be always in contact with one of the faces 15 and 16 of the cam 14 at a middle region thereof. The faces 15 and 16 are electrically insulated from the upper plate member 17 by known means.

The faces 15 and 16 of the cam 14 are spaced from an axis of rotation of the spindle 12 by different distances. The faces 15 are spaced from the axis by a distance which is smaller than the distance by which the faces 16 are spaced from the axis. Thereby, when the upper plate 17 is in contact with one of the faces 15 of the cam 14, its free end is raised so as to be separated from the free end of the lower plate 18. On the other hand, when the upper plate 17 is in contact with one of the cam faces 16 the plates 17 and 18 are urged into contact with one another.

Figure 4:
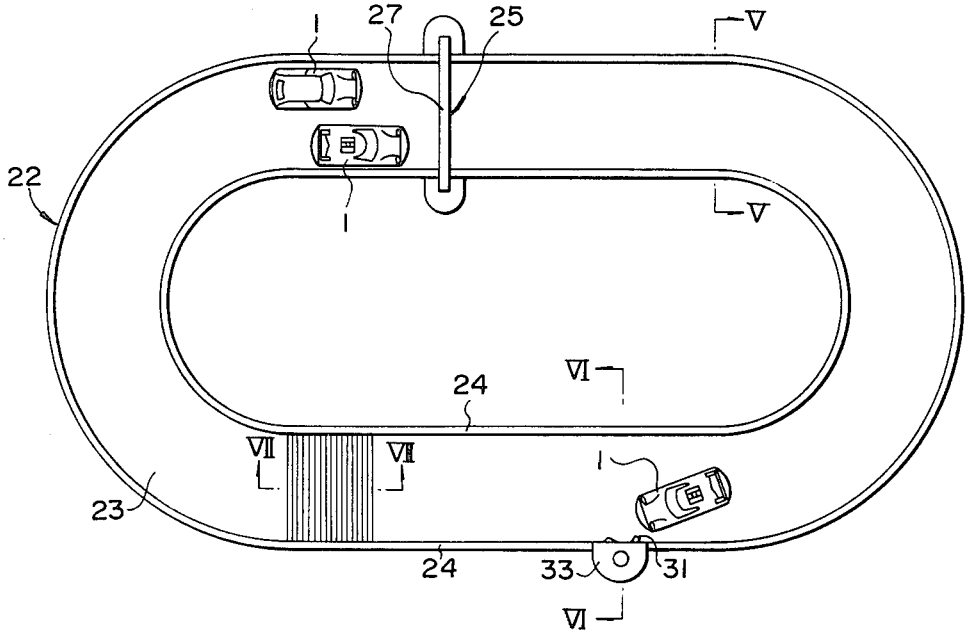
FIG. 4 is a plan view of a toy racing track.
Figure 5:
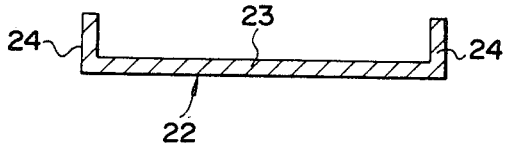
FIG. 5 is a view showing a section of the toy racing track taken along the line V—V of FIG. 4.
Figure 6:
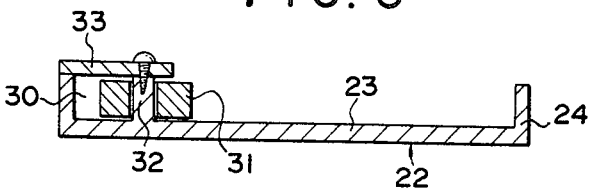
FIG. 6 is a view showing a section of the toy racing track taken along the line VI—VI of FIG. 4.
Figure 7:
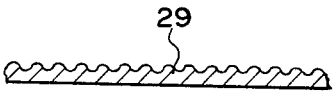
FIG. 7 is a view showing a section of an uneven portion of the toy racing track, taken along the line VII—VII of FIG. 4.
Figure 8:
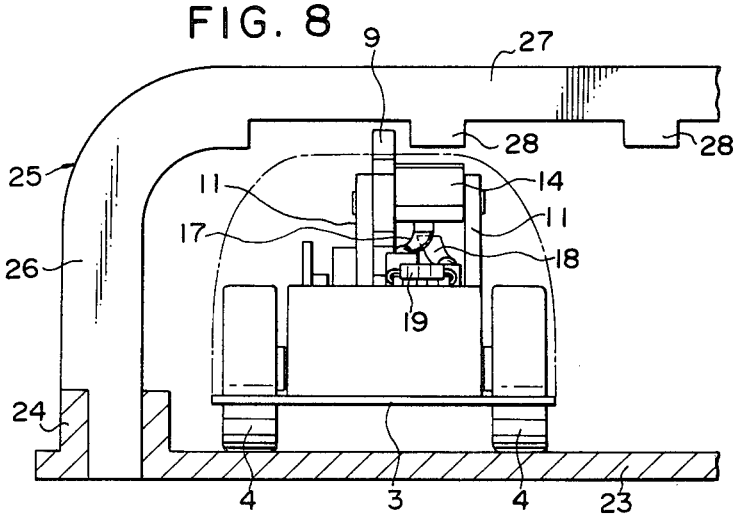
FIG. 8 is a view showing a gate member arranged on the toy racing track, and the toy racing car which passes the gate member.
Figure 9:
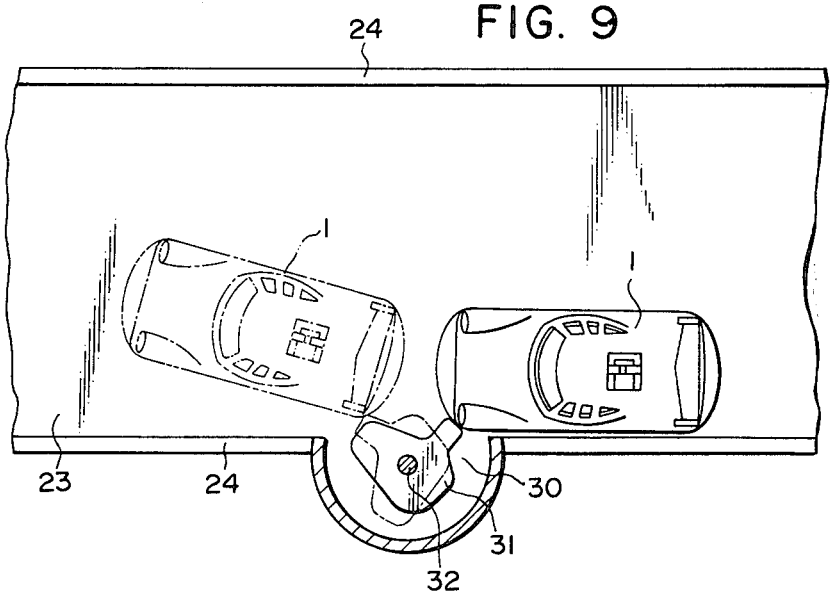
FIG. 9 is a view showing a section of the toy racing track which is provided with an irregularly shaped rotatable cam member.

The toy racing track 22 has a sausage-shaped road with a flat and smooth road surface 23. The road is provided with guardrails 24 which extend along the track 22 at both lateral sides thereof, as shown in FIG. 4. A gate member 25 is provided at one location of the track 22 and has two pillars 26 and ceiling beam 27 together forming a unitary structure. The pillars 26 are supported on the guardrails 24. The ceiling beam 27 has a projection 28 extending downwardly into an inner passage of the gate member 25. The projection 28 of the ceiling beam 27 is located at such a height that when the car 1 passes through the inner passage of the gate member 25 in the region of the projection 28 the claw 10 of the car 1 engages the projection 28. On the other hand, the remainder of the ceiling beam 27 which is free from the projection 28 has such a height that when the car 1 passes through the inner passage of the gate member 25 in the region of the remainder of the latter it does not interfere with the gate member 25.

Furthermore, the track 22 has a section 29 with an uneven road surface. The uneven road surface is formed by a plurality of strips which extend in a direction transverse to the direction of elongation of the track 22. An irregular plate cam 31 extending onto the road surface 23 is provided on the track 22. The plate cam 31 is idly pivoted on a spindle 32 which, in turn, is fixed on a lateral extension 30 of the road surface 23. The plate cam 31 is secured against removal from the spindle 32 by a cover 33. The track 22 has such a width that at least two cars 1 can run on it in parallel with one another.

The toy racing assembly in accordance with the present invention operates in the following manner. Two racing cars 1 are actuated by switching on the switches 20 and placed on the track 22. The cars 1 race with each other along the track 22. They can occassionally collide with each other, against the guardrails 24, and against the rotatable plate cam 31, and thereby change their running directions. They can also jump on the uneven road surface 29 while running. When the cars 1 pass through the gate member 25 in the region of the projection 28, the claws 10 engage the latter, the claw wheels 9 together with the cam 14 turn, and the faces 15 or 16 of the cam 14 urges the plate 17 from or to contact with the plate 18. The resistance 19 becomes electrically connected with or disconnected from the electric circuit of the electric motor 8 so that the latter is driven with or without the resistance 19 at a lower or higher voltage, respectively. Thereby, the cars are driven by the motor 8 at a lower or higher speed. This means that when the cars 1 pass the gate 25 in the region of the projection 28 they shift their running speed from fast to slow, and vice versa.

In the afore-presented disclosure the engaging formation which is engaged by the car is formed as the projection 28 of the gate member 25. It is to be understood that the engaging formation may have a construction differing from that described above. The cam 14 and the claw wheel 9 may have a construction as well as a number and location of the faces 15 and 16 and claws 10 differing from those indicated above. The resistance 19 may be electrically connected with the electric circuit of the electric motor 8 not in the distal position of the plates 17 and 18, but in the proximal position of the latter. More than one gate member 25, section 29 and plate cam 31 may be provided in the assembly.

It will be understood that each of the elements described above, or two or more together, may also find a useful application in other types of constructions differing from the types described above.

While the invention has been illustrated and described as embodied in a toy racing assembly, it is not intended to be limited to the details shown, since various modifications and structural changes may be made without departing in any way from the spirit of the present invention.

Without further analysis, the foregoing will so fully reveal the gist of the present invention that others can, by applying current knowledge, radily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A toy racing assembly, comprising a toy racing car having driving means for driving said car, said driving means including an electric motor having an electric circuit; speed shifting means for shifting the speed of said car; and a toy racing track arranged for guiding said car during running and having at least at one location of said track an engaging formation operative for actuating said speed shifting means, said speed shifting means including a resistance and actuating means operative for electrically connecting said resistance with and electrically disconnecting said resistance from said electric circuit of said electric motor in dependence upon the position of said car relative to said engaging formation when said actuating means engages said formation upon said car passing said formation whereby the speed of said car is shifted to a lower magnitude and to a higher magnitude, respectively.

2. The toy racing assembly as defined in claim 1, wherein said track has a gate member, said engaging formation being provided on said gate member.

3. The toy racing assembly as defined in claim 2, wherein said gate member of said track has an inner passage and is arranged so that said car can pass through said inner passage, said engaging formation being formed as at least one projection extending inwardly of said inner passage of said gate member.

4. The toy racing assembly as defined in claim 3, wherein said gate member has a first portion which is provided with said projection so that when said car passes through said gate member adjacent to said first portion thereof said speed shifting means of said car is actuated by said projection and the speed of said car is shifted, and a second portion which is spaced from said first portion and is free from said projection so that when said car passes through said gate member adjacent to said second portion thereof said speed shifting means of said car is not actuated and the speed of said car is not shifted.

5. The toy racing assembly as defined in claim 4, wherein said track extends in a first direction, said portions of said gate member being spaced from one another in a second direction which is substantially transverse to said first direction.

6. The toy racing assembly as defined in claim 4, wherein said gate member has a ceiling, said projection extending downwardly from said ceiling of said gate member in the region of said first portion of the latter.

7. The toy racing assembly as defined in claim 6, wherein said ceiling of said gate member in the region of said second portion has such a height that said car passes through said second portion of said inner passage of said gate member without interfering with the latter, said projection extending in the region of said first portion of said gate member to such a height that when said car passes through first portion of said inner passage it engages said projection.

8. A toy racing assembly as defined in claim 1, wherein said actuating means includes two plate members which are connected in parallel with said resistance and form electric contacts of the latter, at least one of said plate members being movable to and from contact with the other plate member in dependence upon a position of said car relative to said engaging formation of said track whereby said resistance becomes electrically disconnected from and connected from said electric circuit of said electric motor, respectively, whereby the speed of said car is shifted.

9. The toy racing assembly as defined in claim 8, wherein said actuating means further includes moving means operative for moving said one plate member relative to said other plate member, said moving means including a rotatable cam having at least two circumferentially spaced faces which are arranged to engage and to move said one plate member to and from contact with said other plate member respectively, said actuating means further including means for rotating said cam element.

10. The toy racing assembly as defined in claim 9, wherein at least said one plate member is resilient and is urged toward said cam element under the action of inherent resiliency of said one plate member.

11. The toy racing assembly as defined in claim 9, wherein said cam element is prismatic.

12. The toy racing assembly as defined in claim 11, wherein said cam element is hexagonal.

13. The toy racing assembly as defined in claim 9, wherein said cam is mounted on an axle rotatable about an axis, said rotating means including a claw wheel having a plurality of claws and mounted on said axle, said claw wheel being arranged so that when said car passes said location of said track at least one of said claws engages said formation of said track so that said claw wheel rotates and rotates said axle together with said cam element.

14. The toy racing assembly as defined in claim 13, wherein said claw wheel has six such claws.

15. The toy racing assembly as defined in claim 13, wherein said car has a body having a top wall which is provided with an opening, said claw wheel being located so that during its rotation at least one of said claws extends through said opening outwardly beyond said top wall of said body of said car.

16. The toy racing assembly as defined in claim 15, wherein said claw wheel has a predetermined number of said claws circumferentially spaced from one another at predetermined locations, said cam element having a plurality of such surfaces whose number is equal to the number of said claws and whose circumferential locations are identical to the circumferential locations of said claws of said claw wheel.

17. The toy racing assembly as defined in claim 16, wherein said surfaces of said cam element include alternately located first and second surfaces which are spaced from said axis of rotation by longer and shorter distances, respectively, so as to move during rotation of said cam said one plate member toward and apart from said other plate member, respectively.

18. The toy racing assembly as defined in claim 1, wherein said track has at least one section having an uneven road surface.

19. The toy racing assembly as defined in claim 18, wherein said track extends in a first direction, said uneven road surface being formed by a plurality of strips extending in a second direction which is substantially transverse to said first direction.

20. The toy racing assembly as defined in claim 1, wherein said track has a road surface; and further comprising at least one freely rotatable cam member which at least partially extends onto said road surface of said track so that said car during running can collide against said cam member.

21. The toy racing assembly as defined in claim 20, wherein said cam member has an irregular shape.

22. The toy racing assembly as defined in claim 20, wherein said track has a laterally extending portion, said cam member being mounted on a spindle which is fixed in said laterally extending portion of said track.

23. The toy racing assembly as defined in claim 1, wherein said track extends in a first direction and has a width, as considered in a second direction transverse to said first direction, which width is such that at least two such toy racing cars can run in parallel to one another on said track.

24. The toy racing assembly as defined in claim 23, wherein said track is provided with two guardrails extending in said first direction and located at both sides of said track spaced from one another in said second direction.

25. The toy racing assembly as defined in claim 1, wherein said driving means further including, dry cells for said electric motor provided in said circuit, and an electric switch in said electric circuit for switching said electric motor.

* * * * *